US008160460B2

(12) United States Patent
Yokochi

(10) Patent No.: US 8,160,460 B2
(45) Date of Patent: Apr. 17, 2012

(54) IMAGE FORMING APPARATUS FOR STORING INFORMATION IN MEMORY ON REMOVABLE CARTRIDGE

(75) Inventor: Atsushi Yokochi, Chiryu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 419 days.

(21) Appl. No.: 12/413,895

(22) Filed: Mar. 30, 2009

(65) Prior Publication Data

US 2009/0297170 A1 Dec. 3, 2009

(30) Foreign Application Priority Data

May 29, 2008 (JP) ..... 2008-141414

(51) Int. Cl.
*G03G 15/00* (2006.01)
*G03G 21/16* (2006.01)

(52) U.S. Cl. ..... 399/12; 399/111

(58) Field of Classification Search ..... 399/12, 399/13, 111, 119
See application file for complete search history.

(56) References Cited

U.S. PATENT DOCUMENTS 6,493,519 B2 * 12/2002 Sasame et al. ..... 399/111
7,043,169 B2 * 5/2006 Ito et al. ..... 399/111
7,761,014 B2 * 7/2010 Fukushima
2006/0029399 A1 * 2/2006 Park et al. ..... 399/12
2007/0092268 A1 * 4/2007 Takahashi ..... 399/12
2008/0279568 A1 * 11/2008 Sugiura ..... 399/12

FOREIGN PATENT DOCUMENTS

| | | |
|---|---|---|
| JP | 10-105021 | 4/1998 |
| JP | 11-305498 | 11/1999 |
| JP | 2000-089642 | 3/2000 |
| JP | 2001-215862 | 8/2001 |
| JP | 2002-288367 | 10/2002 |
| JP | 2002-341706 | 11/2002 |

OTHER PUBLICATIONS

Notification of Reason for Refusal in corresponding Japanese Patent Application 2008-141414 mailed on Apr. 20, 2010.

* cited by examiner

*Primary Examiner* — Susan Lee
(74) *Attorney, Agent, or Firm* — Banner & Witcoff, Ltd.

(57) ABSTRACT

An image forming apparatus includes: an apparatus main body; a plurality of cartridges removably mounted to the apparatus main body and accommodating developer of respective colors, each of the cartridges including a nonvolatile memory; and a storing control unit provided in the apparatus main body. The storing control unit is configured to store, in each of the nonvolatile memories, given information on all of the cartridges and identification information of the cartridges in response to a use of at least one of the cartridges, such that the given information on each of the cartridges is associated with identification information of a respective one of the cartridges.

12 Claims, 7 Drawing Sheets

CURRENT INFORMATION STORAGE AREA

| ID CODE | NUMBER OF PRINTS | CONNECTION FAILURE FLAG |
|---|---|---|
| 1111C | 125 | 0 |
| 2222M | 125 | 0 |
| 3333Y | 187 | 0 |
| 4444K | 2383 | 0 |

IMAGE FORMING APPARATUS FOR STORING INFORMATION IN MEMORY ON REMOVABLE CARTRIDGE

CROSS-REFERENCE TO RELATED APPLICATIONS

This application is based upon and claims priority from Japanese Patent Application No. 2008-141414 filed on May 29, 2008, the entire contents of which are incorporated herein by reference.

TECHNICAL FIELD

The present invention relates to an image forming apparatus such as a color printer, and a computer readable medium

BACKGROUND

An image forming apparatus including a main body to process cartridges for the respective colors are removably mountable is known. In the process cartridge, a photosensitive drum and various members for forming toner images on the photosensitive drums are integrated. With this configuration, for example, when the life of the process cartridge comes to an end (for example, the remaining amount of the toner becomes a predetermined amount or less), the process cartridge can be removed from the apparatus main body and a new process cartridge can be mounted to the apparatus main body.

In such an image forming apparatus, the process cartridge is provided with a memory and a cumulative number of printed sheets (number of prints) printed by using the process cartridge is stored in the memory for determining the life of the process cartridge (for example, see JP-A-2001-215862). For example, when the cumulative number of printed sheets (cumulative number of sheets) stored in the memory exceeds a predetermined number, it can be determined that the life of the process cartridge provided with the memory has come to an end.

SUMMARY

A controller for controlling read and write of data of the memory is normally provided in the apparatus main body. By connecting the controller and the memory so as to communicate with each other, data can be written into the memory.

However, in the configuration in which the process cartridge is removably mounted to the apparatus main body, a communication failure (connection failure) may occur between the controller and the memory. Particularly, in the configuration in which the controller and the memory are connected by a contact between a controller-side terminal and a memory-side terminal (contact system), a communication failure due to a connection failure between the terminals is likely to occur. If a communication failure occurs between the controller and the memory at the timing of writing of the number of prints on the memory, the number of prints cannot be written on the memory, and a new number of prints is not added to the cumulative number of prints stored in the memory. As a result, the cumulative number of prints stored in the memory becomes inaccurate.

The present invention was conceived in consideration of the above-described circumstances, and an object thereof is to provide an image forming apparatus which can keep accurate information in cartridges.

According to an aspect of the invention, there is provided an image forming apparatus comprising: an apparatus main body; a plurality of cartridges removably mounted to the apparatus main body and accommodating developer of respective colors, each of the cartridges comprising a nonvolatile memory; and a storing control unit provided in the apparatus main body and configured to store, in each of the nonvolatile memories, given information on all of the cartridges and identification information of the cartridges in response to a use of at least one of the cartridges, such that the given information on each of the cartridges is associated with identification information of a respective one of the cartridges.

According to another aspect of the invention, there is provided an image forming apparatus comprising: an apparatus main body to which a plurality of cartridges removably mountable and accommodating developer of respective colors, each of the cartridges comprising a nonvolatile memory; and a storing control unit configured to store, in each of the nonvolatile memories of the cartridges mounted to the apparatus main body, given information on all of the cartridges mounted to the apparatus main body and identification information of the cartridges mounted to the apparatus main body in response to a use of at least one of the cartridges mounted to the apparatus main body, such that the given information on each of the cartridges mounted to the apparatus main body is associated with identification information of a respective one of the cartridges mounted to the apparatus main body.

According to still another aspect of the invention, there is provided a computer readable medium having a computer program stored thereon and readable by a computer, said computer program, when executed by the computer, causes the computer to perform operations for an image forming apparatus to which a plurality of cartridges removably mountable, said operations comprising: detecting a use of at least one of the cartridges mounted to the cartridge mounting unit; storing, in each of nonvolatile memories provided in the cartridges mounted to the image forming apparatus, given information on all of the cartridges mounted to the image forming apparatus and identification information of the cartridges mounted to the image forming apparatus in response to the use of at least one of the cartridges mounted to the image forming apparatus, such that the given information on each of the cartridges mounted to the image forming apparatus is associated with identification information of a respective one of the cartridges mounted to the image forming apparatus.

DESCRIPTION

Hereinafter, an exemplary embodiment of the present invention will be described in detail with reference to the accompanying drawings.

1. Entire Configuration of Color Printer

Figure 1:
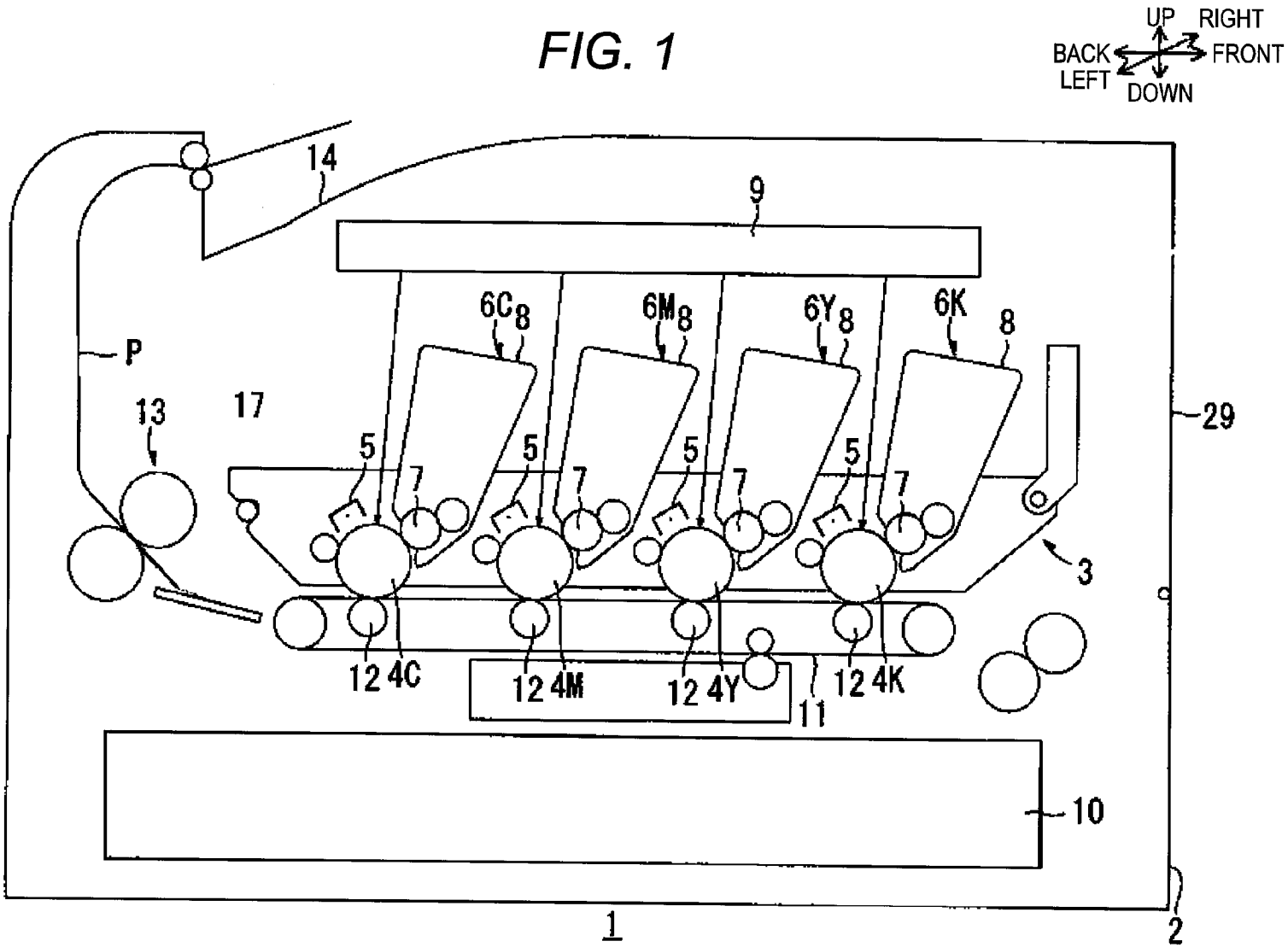
FIG. 1 is a side sectional view of a color printer of an exemplary embodiment of the present invention.

FIG. 1 is a side sectional view of a color printer 1 according to an exemplary embodiment of the present invention.

The color printer 1 is a tandem color printer, as an example of an image forming apparatus. The color printer 1 includes: a main body casing 2 as an example of an apparatus main body; and a drum unit 3 provided in the main body casing 2. This drum unit 3 is removably mounted to the main body casing 2 through an opening formed in one side surface of the main body casing 2. The main body casing includes a cover 29 configured to open and close the opening.

The drum unit 3 includes four photosensitive drums 4. The four photosensitive drums 4 are provided for four colors of black, yellow, magenta and cyan, respectively. The photosensitive drums 4 are arranged in parallel at even intervals in the order of these colors in a conveyance direction of a sheet P.

The drum unit 3 includes: scorotron chargers 5; and developing cartridges 6 as an example of cartridges corresponding to the respective photosensitive drums 4. Each of the developing cartridges 6 includes: a developing roller 7 configured to supply toner (an example of developer) to the photosensitive drum 4; and a cartridge housing 8 which has a box shape for accommodating toner therein and holds the developing roller 7 at a lower end portion thereof such that a part of the peripheral surface of the developing roller 7 is exposed. Each developing cartridge 6 is removably mounted to the drum unit 3.

The color printer 1 includes an exposure unit 9 provided above the drum unit 3 and configured to emit four laser beams corresponding to the respective colors.

Along with rotations of the photosensitive drums 4, the surfaces of the photosensitive drums 4 are evenly charged by the scorotron chargers 5, and then selectively exposed to the laser beams from the exposure unit 9. By this exposure, the charges are selectively removed from the surfaces of the photosensitive drums 4, whereby electrostatic latent images are formed on the surfaces of the photosensitive drums 4. When the electrostatic latent images are opposed to the developing rollers 7, toners are supplied to the electrostatic latent images from the developing rollers 7. Accordingly, toner images are formed on the surfaces of the photosensitive drums 4.

Instead of the exposure unit 9, four LED arrays may be provided corresponding to the respective photosensitive drums 4.

The color printer 1 further includes a sheet feed cassette 10, a conveyance belt 11, and four transfer rollers 12. The sheet feed cassette 10 is disposed at a bottom portion of the main body casing 2 and configured to store sheets P therein. The sheets P stored in the sheet feed cassette 10 are conveyed onto the conveyance belt 11 by various rollers. The conveyance belt 11 disposed below the photosensitive drums 4 and opposing the four photosensitive drums 4. The transfer rollers 12 are disposed at respective positions opposing the photosensitive drums 4 across the conveyance belt 11. The sheet P conveyed onto the conveyance belt 11 passes through between the conveyance belt 11 and the photosensitive drums 4 in order by a running of the conveyance belt 11. When the photosensitive drums opposes the sheet P, toner images formed on the surfaces of the photosensitive drums 4 are transferred to the sheet P due to a transfer bias applied to the transfer rollers 12.

The color printer 1 includes a fixing unit disposed at a downstream side of the conveyance belt 11 in the conveyance direction of the sheet P. The sheet P having the toner images transferred thereto is conveyed to the fixing unit 13. The fixing unit 13 heats and pressurizes the sheet P so as to fix the toner images on the sheet P. The sheet P having the toner images fixed thereon is discharged to a sheet discharge tray 14 provided on an upper surface of the main body casing 2 via various rollers.

In the drawings, K (black), Y (yellow), M (magenta), and C (cyan) indicating the respective colors are suffixed to the reference numerals of the photosensitive drums 4 and the developing cartridges 6.

2. Electric Configuration of Color Printer

Figure 2:
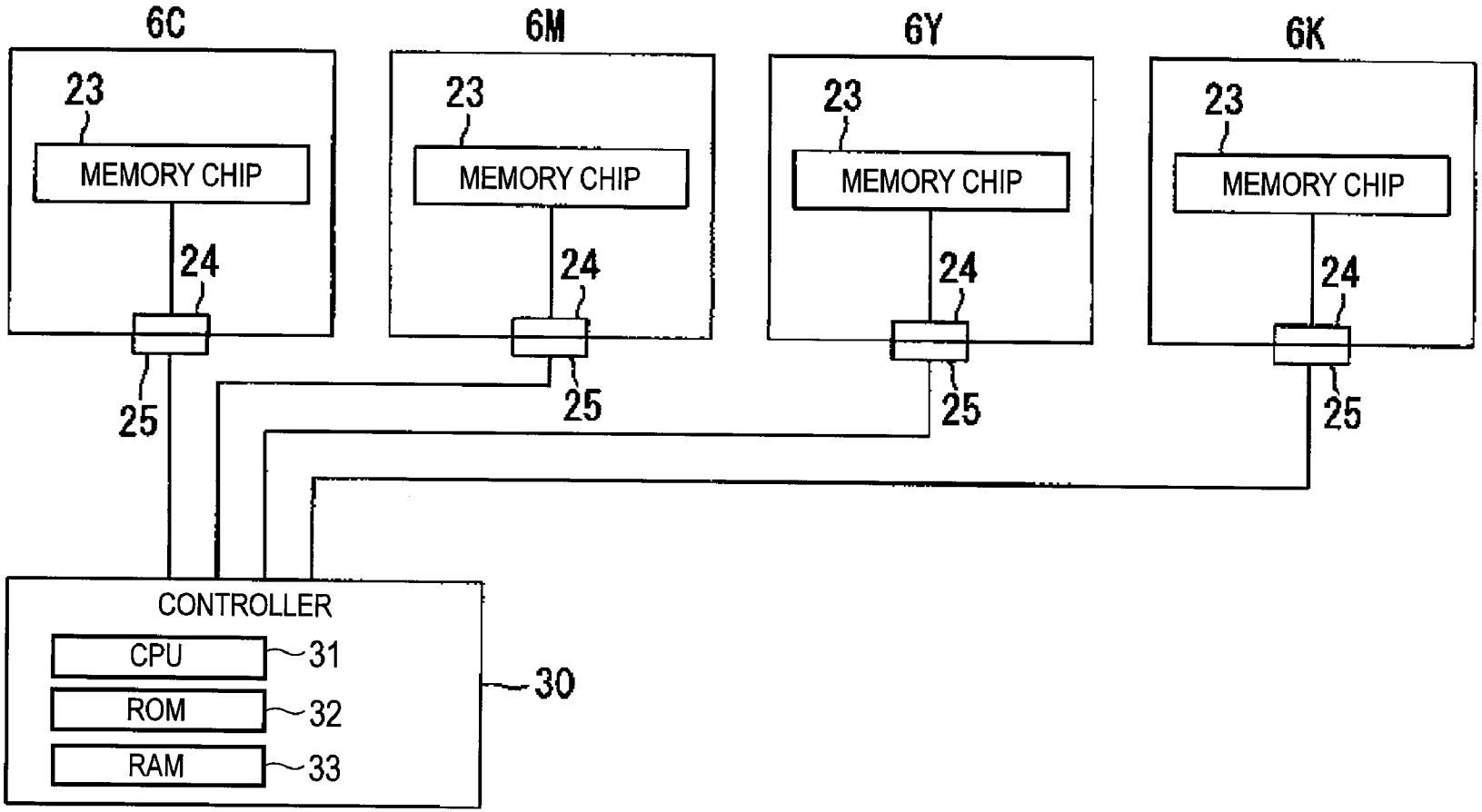
FIG. 2 is a block diagram schematically illustrating an electric configuration of the color printer.

As shown in FIG. 2, each developing cartridge 6 includes: a memory chip 23 as an example of a nonvolatile memory; and a memory-side terminal 24 electrically connected to the memory chip 23. The memory-side terminal 24 is disposed on an outer surface of the cartridge housing 8 of the developing cartridge 6.

The color printer 1 further includes a controller 30 as an example of a storing control unit and configured to read and write operations to each memory chip 23. The controller 30 is configured, for example, by an IC chip including an arithmetic circuit and a memory, etc. Specifically, in this embodiment, the controller 30 includes a central processing unit (CPU) 31, a read only memory (ROM) 32 and a random access memory (RAM) 33. The CPU 31 is operable to perform certain operations for the color printer 1. The ROM 32 stores various programs to be executed by the CPU 31 for performing various operations. The RAM 33 provides temporally storage area used when the CPU 31 performs the operations. The controller 30 may be configured by hardware.

The image forming apparatus 1 includes four main body-side terminals 25, each of which is electrically connected to the controller 30. Each of the main body-side terminals 25 is disposed at positions to be connected to (contact) a respective one of the memory-side terminals 24 provided on the developing cartridges 6 when the four black, yellow, magenta, and cyan developing cartridges 6 are mounted to the drum unit 3 (see FIG. 1). When the main body-side terminal 25 is connected to the memory-side terminals 24, the controller 30 can communicate with the memory chips 23.

Figures 7, 8:
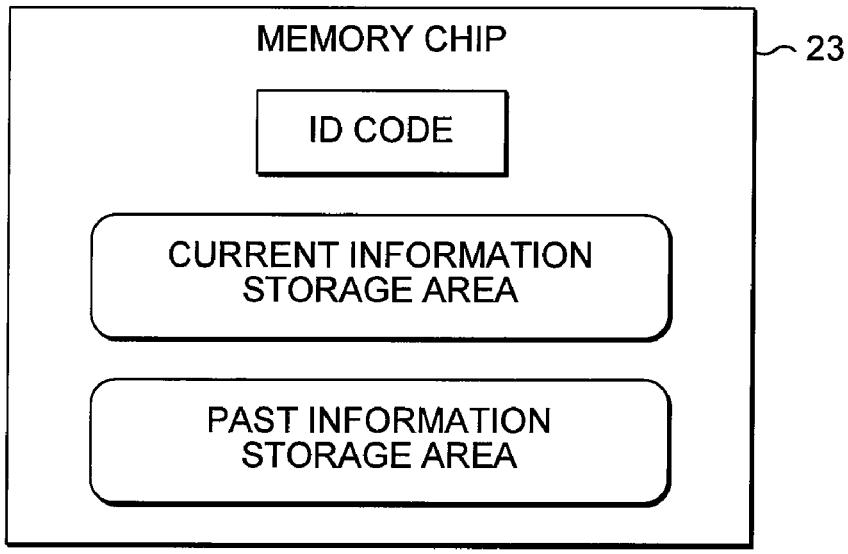
FIG. 7 is a schematic diagram illustrating a stored content of a memory chip shown in FIG. 2.
FIG. 8 is an example of a content stored in a current information storage area shown in FIG. 7.

The developing cartridge 6 has a unique ID code assigned thereto. The ID code of assigned to the developing cartridge 6 is written in the memory chip 23 mounted in the developing cartridge 6, for example, before shipment of the color printer 1. As shown in FIG. 7, the memory chip 23 can provide therein a current information storage area and a past information storage area in addition to an area for storing ID codes.

The current information storage area is reserved for storing information on four developing cartridges 6 mounted to the color printer 1 at present. In detail, the current information storage area is reserved for storing, in association with the ID codes of the four developing cartridges 6 mounted to the color printer 1 at present, given information on the developing cartridges 6 of the respective ID codes and connection failure flags which indicate whether a connection failure occurs between the memory-side terminals 24 of the developing cartridges 6 of the respective ID codes and the main body-side terminals 25. Specifically, the connection failure flag is set to 0 or 1. The connection failure flag set to 0 indicates that no connection failure occurs. In contrast, the connection failure flag set to 1 indicates that the connection failure occurs. The connection failure flag set to 1 is an example of connection failure information.

The past information storage area is reserved for storing information on developing cartridges 6 used in the past together with the developing cartridges 6 on which the memory chips 23 are mounted.

The information stored in the current information storage area and the past information storage area are rewritten by the information storing processing and synchronization processing.

Examples of a content of the given information on the developing cartridge 6 include a cumulative consumption amount or a remaining amount of toner accommodated in the developing cartridge 6, a cumulative number of printing operations (image forming operations) executed by using the developing cartridges 6 (hereinafter, referred to as "cumulative number of prints of the developing cartridge 6," simply) etc. In the present exemplary embodiment, as given information on the developing cartridge 6, a cumulative number of prints of the developing cartridge 6 is adopted. Therefore, as shown in FIG. 8, the ID code, the cumulative number of prints of the developer cartridge 6 and the connection failure flag are stored, for all the cartridges 6 mounted to the color printer 1, in association with one another.

One printing operation (image forming operation) corresponds to forming an image on one surface of the sheet P.

3. Information Storing Processing

In the color printer 1, when the power supply is turned on or the cover 29 is closed, preparation (warm-up operation) for starting a printing operation is performed. At this time, the controller 30 reads ID codes of the developing cartridges 6 including the memory chips 23, from each of the memory chips 23. Accordingly, the controller 30 can grasp the ID codes of the four developing cartridges 6 mounted inside the main body casing 2. Specifically, the ID codes read from the memory chips 32 are stored in the RAM 33.

Figure 3:
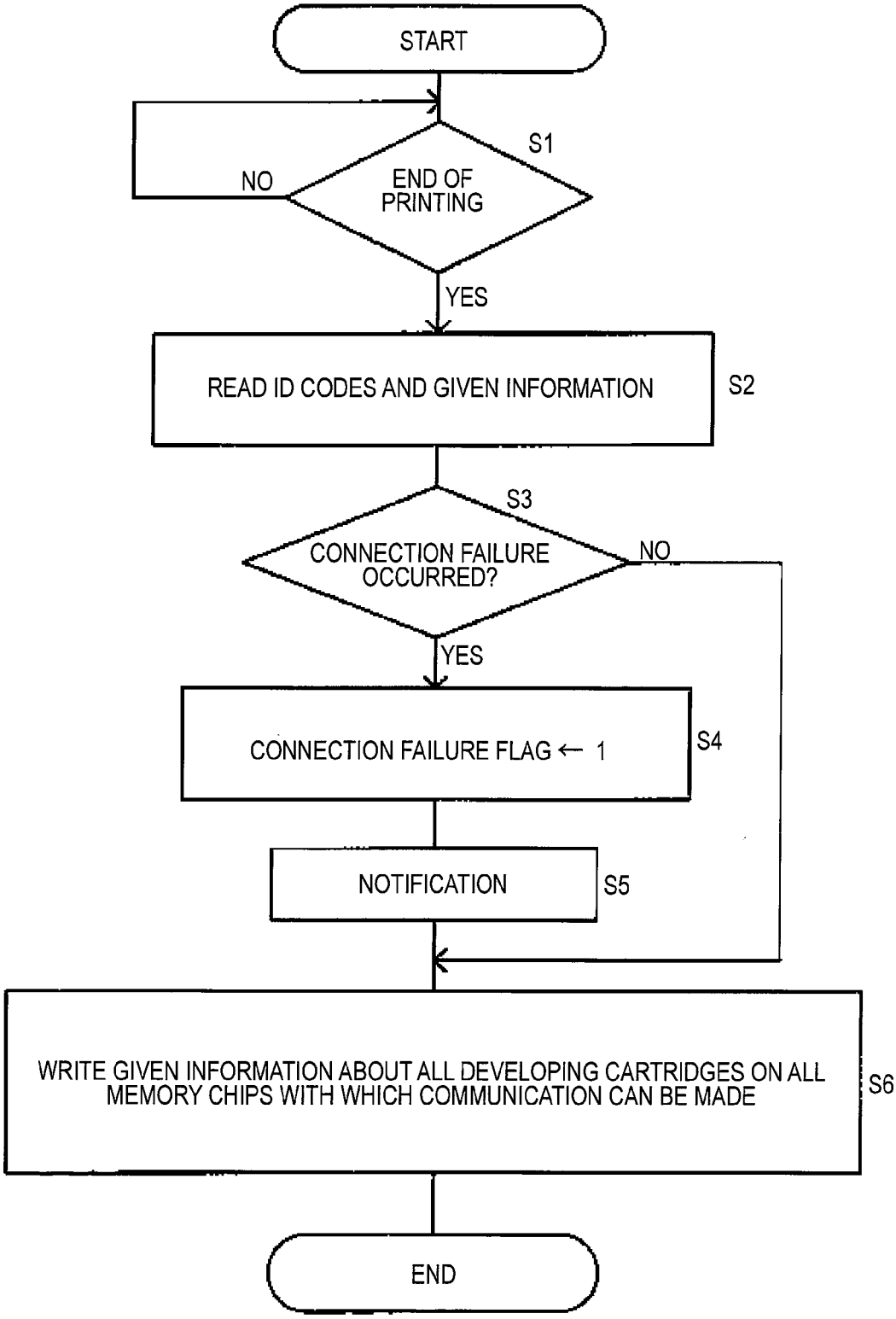
FIG. 3 is a flowchart of information storage processing to be executed by a controller shown in FIG. 2.

Thereafter, when a printing operation is performed, the controller 30 (especially, CPU 31) executes the information storing processing shown in FIG. 3.

In the information storing processing, the printing operation is repeated a certain number of times, and if the series of printing operations are finished (S1: YES), the controller 30 reads ID codes of the developing cartridges 6 having the memory chips 23, the cumulative numbers of prints and connection failure flags stored by being associated with the ID codes from the current information storage areas of the respective memory chips 23 (S2).

At this time, it is determined whether the ID codes and the cumulative number of prints could not be read from any of the memory chips 23, that is, whether a connection failure has occurred between any of the memory-side terminals 24 and the corresponding main body-side terminal 25 (S3).

If a connection failure occurs between any of the memory-side terminals 24 and the corresponding main body-side terminal 25 (S3: YES), on the controller 30, a connection failure flag associated with the ID code of the developing cartridge 6 which has the memory-side terminal 24 causing the connection failure is set to 1 (S4).

Thereafter, the occurrence of the connection failure is indicated, for example, by lighting an error lamp provided on the upper surface of the main body casing 2 (S5). Accordingly, a user can recognize that a connection failure has occurred, and can be urged to eliminate the connection failure.

Thereafter, on the controller 30, to the cumulative numbers of prints read out from the memory chips 23, the new numbers of printing operations performed by using the developing cartridges 6 corresponding to the read cumulative number of prints are added, and the cumulative numbers of prints after being added are set as the latest cumulative numbers of prints.

For example, when the printing operation is an operation for forming a monochrome image (a single-color image in black) on the sheet P and this operation is performed three times (the monochrome image is formed on three sheets P), "3" is added to the cumulative number of prints of the developing cartridge 6 for black. When the printing operation is an operation for forming a full-color image on the sheet P and this operation is performed 5 times (when the full-color image is formed on five sheets P), "5" is added to the cumulative numbers of prints of all developing cartridges 6.

Then, in each of the memory chips 23 capable of communicating with the controller 30, information stored in the current information storage area is moved to the past information storage area. Thereafter, on the current information storage area of each of the memory chips 23 capable of communicating with the controller 30, the latest cumulative numbers of prints and connection failure flags of all developing cartridges 6 mounted to the main body casing 2 are written by being associated with the ID codes (S6). Then, this information storing processing ends.

4. Synchronization Processing (1) First Synchronization Processing

Figure 4:
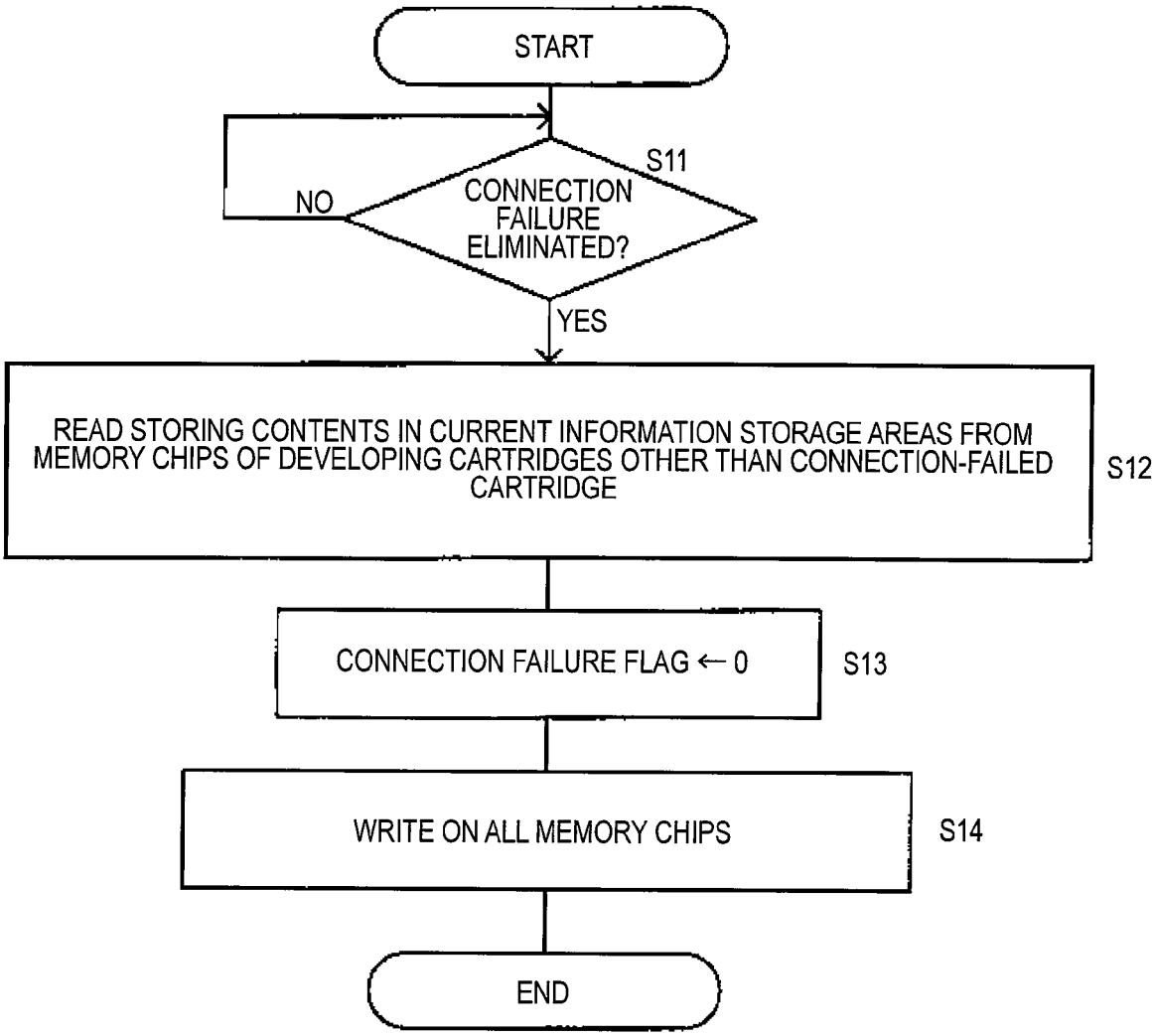
FIG. 4 is a flowchart of first synchronization processing to be executed by the controller shown in FIG. 2.

FIG. 4 is a flowchart of first synchronization processing.

The synchronization processing is processing for matching the stored contents in the current information storage areas of the memory chips 23 of the four developing cartridges 6 mounted to the color printer 1. The synchronization processing shown in FIG. 4 is executed by the controller 30 on a condition that at least one connection failure flag 1 is set to 1 on the controller 30, or on a condition that at least one of the connection failure flags stored in the current information storage areas of the memory chips 23 capable of communicating with the controller 30 is set to 1.

In the synchronization processing, it is determined whether all connection failures between the memory-side terminals 24 and the main body-side terminal 25 have been eliminated (S11).

When all connection failures are eliminated (S11: YES), from the memory chip 23 of any of the developing cartridges 6 except for the developing cartridges 6 (hereinafter, referred to as "connection-failed cartridges 6") having the memory side terminals 24 which has caused the connection failures with the main body-side terminal 25, all stored contents in the current information storage areas are readout (S12). For example, in the case where a connection failure occurs between the memory-side terminal 24 of the developing cartridge 6 for black and the main body-side terminal 25, when this connection failure is eliminated, all the stored contents of the current information storage area are read on the controller 30 from any one of the memory chips 23 of the developing cartridges 6 for yellow, magenta, and cyan.

Then, on the controller 30, all connection failure flags are set to 0 (zero) (S13).

Thereafter, on the current information storage areas of all memory chips 23, the latest cumulative numbers of prints (read at S12) and the connection failure flags ("0" set at S13) of all developing cartridges 6 mounted to the main body casing 2 are written in association with the ID codes (S14). Accordingly, the contents stored in the current information storage areas of the memory chips 23 are matched with one another, and the synchronization processing shown in FIG. 4 ends.

(2) Second Synchronization Processing

Figure 5:
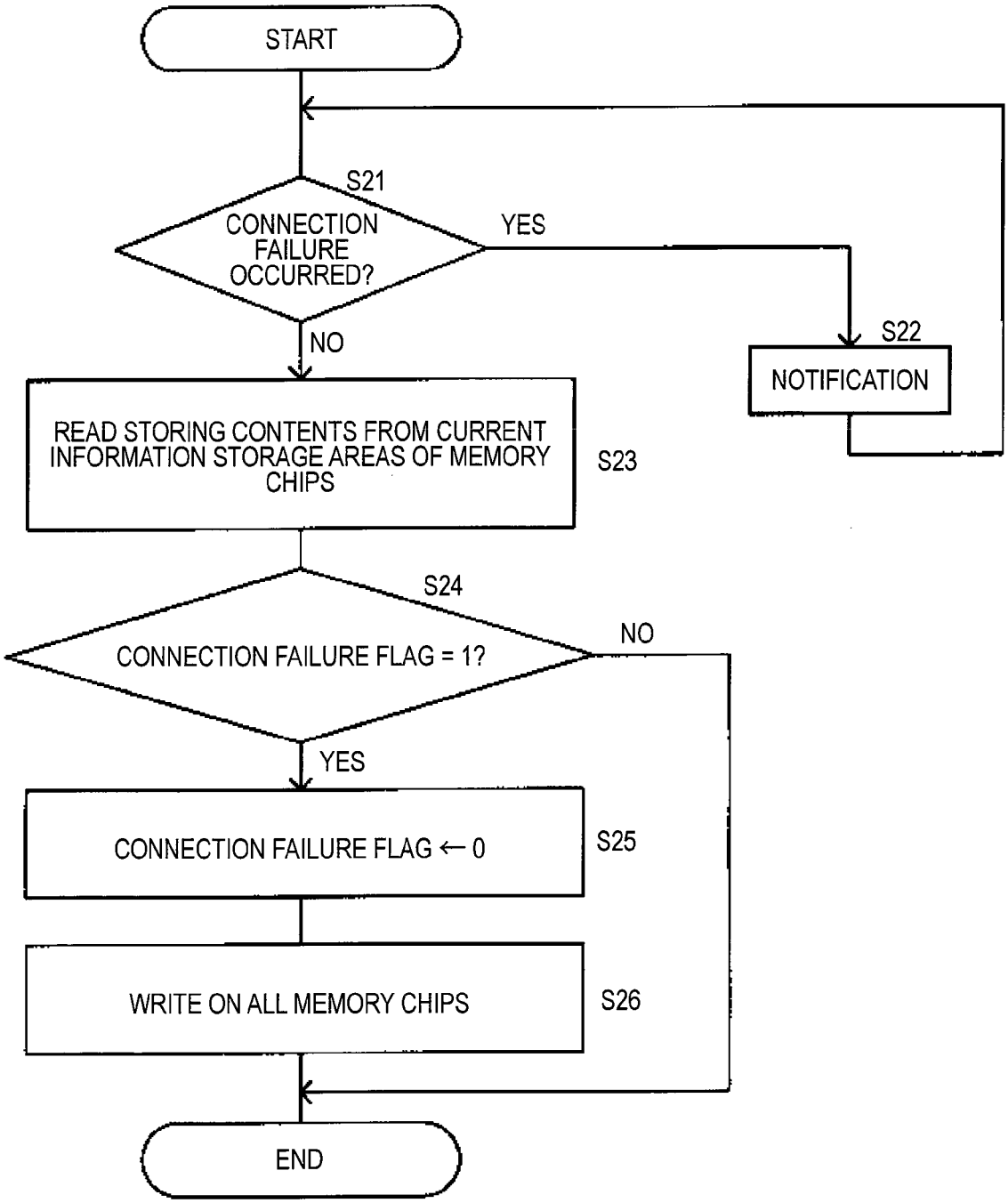
FIG. 5 is a flowchart of second synchronization processing to be executed by the controller shown in FIG. 2.

FIG. 5 is a flowchart of second synchronization processing.

For examples in some cases, after a printing operation is performed in a state where a connection failure occurs between any of the memory-side terminals 24 and the main body-side terminal 25, while the connection failure is not eliminated, the power supply of the color printer 1 is turned off. In this case, the synchronization processing shown in FIG. 4 is not performed, and thereafter, at the time the power supply of the color printer 1 is turned on, the stored contents in the current information storage areas of all memory chips 23 do not match on another.

Therefore, when the power supply of the color printer 1 is turned on, the synchronization processing shown in FIG. 5 is performed by the controller 30.

First, it is determined whether a connection failure has occurred between any of the memory-side terminals 24 and the corresponding main body-side terminal 25 (S21).

If a connection failure occurs between any of the memory-side terminals 24 and the corresponding main body-side terminal 25 (S21: YES), the connection failure is indicated, for example, by lighting the error lamp provided on the upper surface of the main body casing 2 (S22). Accordingly, a user can recognize that a connection failure has occurred, and can be urged to eliminate the connection failure. Then, after notifying the connection failure, it is determined again whether a connection failure has occurred between any of the memory-side terminals 24 and the main body-side terminal 25 (S21).

If the connections between all memory-side terminals 24 and the main body-side terminal 25 are good (S21: NO), all stored contents in the current information storage areas are readout on the controller 30 from all memory chips 23 (S23).

Then, it is determined whether any of the connection failure flags readout on the controller 30 has been set to 1(S24).

If at least one connection failure flag is set to 1 (S24: YES), on the controller 30, all connection failure flags are set to 0 (zero) (S25).

Thereafter, on the current information storage areas of all memory chips 23, the latest cumulative numbers of prints (e.g., cumulative numbers of prints of a developing cartridge 6 assigned to the connection failure flag "0" determined at S24) and connection failure flags ("0" set at S25) of all developing cartridges 6 mounted to the main body casing 2 are written in association with the ID codes, respectively (S26). Accordingly, the contents stored in the current information storage areas of the memory chips 23 match one another, and the synchronization processing shown in FIG. 5 ends.

On the other hand, if all connection failure flags readout onto the controller 30 from the memory chips 23 are all set to 0 (zero) (S24: NO), the stored contents in the current information storage areas of the memory chips 23 match one another, so that the steps S25 and S26 are skipped and the synchronization processing of FIG. 5 ends.

(3) Third Synchronization Processing

Figure 6:
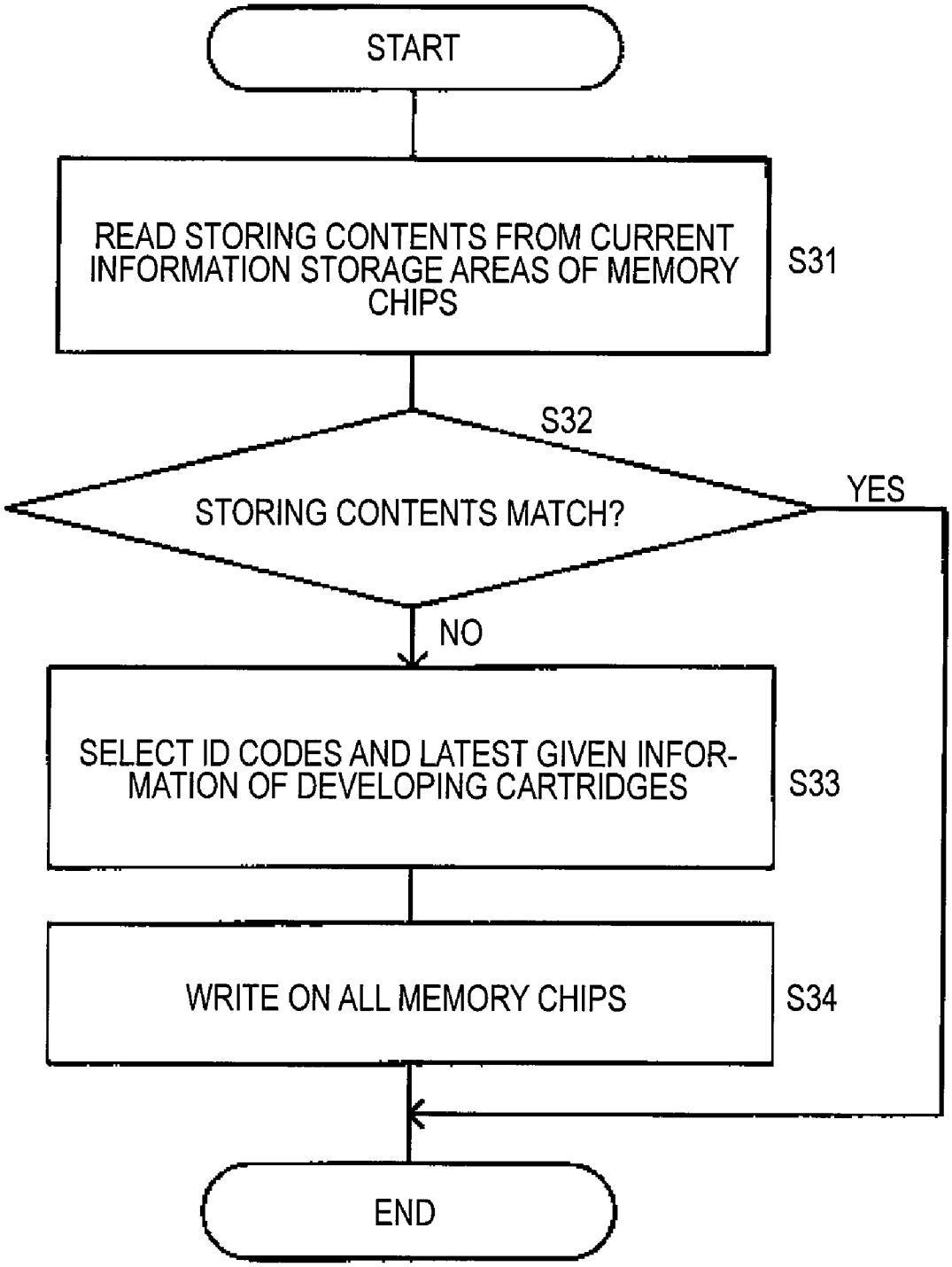
FIG. 6 is a flowchart of third synchronization processing to be executed by the controller shown in FIG. 2.

FIG. 6 is a flowchart of third synchronization processing.

For example, in some cases, the developing cartridge 6 is replaced while the power supply of the color printer 1 is turned off. In this case, when the power supply of the color printer 1 is turned on, the stored contents in the current information storage areas of all memory chips 23 do not match one another.

Therefore, when the power supply of the color printer 1 is turned on and it is confirmed that the connections between all memory-side terminals 24 and the respective main body-side terminals 25 are good, first, all stored contents in the current information storage areas are readout on the controller 30 from the memory chips 23 of all developing cartridges 6 (S31).

Then, it is determined whether the stored contents readout on the controller 30 match one another (S32).

If the stored contents do not match one another (S32: NO), from these stored contents, the ID codes of the four developing cartridges 6 currently mounted to the color printer 1 and the cumulative numbers of prints associated with the ID codes are selected. Then, for each ID code, the maximum cumulative number of prints is selected as the latest cumulative number of prints among the cumulative numbers of prints associated with the ID code (533).

Thereafter, on the current information storage areas of all memory chips 23, the latest cumulative numbers of prints and the connection failure flags of all developing cartridges 6 mounted to the main body casing 2 are written in association with the ID codes, respectively (S34). Accordingly, the contents stored in the current information storage areas of the memory chips 23 match one another, and the synchronization processing shown in FIG. 6 ends.

On the other hand, if the stored contents readout on the controller 30 from the memory chips 23 completely match one another (S32: YES), the steps S33 and S34 are skipped and the synchronization process shown in FIG. 6 ends.

5. Advantages

As described above, a plurality of developing cartridges 6 for forming developer images in the respective predetermined colors are removably mounted to the main body casing 2. Each developing cartridge 6 is provided with the memory chip 23. The main body casing 2 includes a controller 30. The controller 30 stores the latest cumulative numbers of prints of all developing cartridges 6 in the current information storage areas of the memory chips 23 in response to use of at least one developing cartridge 6 by associating these with ID codes unique to the respective developing cartridges 6 and the updating dates of the cumulative numbers of prints. Therefore, when the developing cartridges 6 are used in the state where a communication failure occurs between the controller 30 and at least one memory chip 23, even if the latest cumulative number of prints is not stored in the current information storage area of the memory chip 23 which cannot currently communicate with the controller 30, the latest cumulative numbers of prints of all developing cartridges 6 mounted to the main body casing 2 including the cumulative number of prints of the developing cartridge 6 of the memory chip 23 which failed to communicate with the controller are stored in the current information storage areas of other memory chips 23. Therefore, in any of the memory chips 23, the latest cumulative numbers of prints of all developing cartridges 6 can be correctly held.

The cumulative number of prints is information showing a physical amount which fluctuates along with use of the developing cartridge 6, so that based on the cumulative number of prints, the degree of deterioration and/or the life of the developing cartridge 6 can be accurately determined. Therefore, maintenance or replacement of the developing cartridge 6 can be performed at a proper time. As a result, deterioration in the printing quality can be prevented.

In response to use of at least one developing cartridge 6, in the respective memory chips 23, the cumulative numbers of prints which has been stored in the current information storage areas until then (the cumulative numbers of prints before being updated) are moved to the past information storage areas. Accordingly, in the respective memory chips 23, the records of the changes in cumulative number of prints of the developing cartridges 6 can be recorded.

Each developing cartridge 6 is provided with a memory-side terminal 24. The memory-side terminals 24 are electrically connected to the respective memory chips 23. The main body casing 2 is provided with main body-side terminals 25. The main body-side terminals 25 are connected to the respective memory-side terminals 24 individually for communications with the memory chips 23. In the state where the memory-side terminals 24 and the respective main body-side terminals 25 are connected, the memory chips 23 and the controller 30 can communicate with each other, and when a connection failure occurs between the memory-side terminal 24 and the main body-side terminal 25, the memory chip 23 and the controller 30 cannot communicate with each other. In the color printer 1, each developing cartridge 6 is removably mounted to the main body casing 2, so that a connection failure is likely to occur between the memory-side terminal 24 and the main body-side terminal 25. However, in the current information storage areas of the memory chips 23 whose memory-side terminals 24 are excellently connected to the respective main body-side terminals 25 and which can communicate with the controller 30 via the connections, the cumulative numbers of prints of all developing cartridges 6 mounted to the main body casing 2 are stored, so that the cumulative numbers of prints of all developing cartridges 6 can be accurately held.

When at least one developing cartridge 6 is used in the state where a connection failure occurs between at least one pair of memory-side terminal 24 and main body-side terminal 25, after this connection failure is eliminated, the controller 30 writes the cumulative numbers of prints stored in the current information storage areas of other memory chips 23 on the current information storage area of the memory chip 23 connected to the memory-side terminal 24 which has caused the connection failure. Accordingly, the cumulative numbers of prints stored in the current information storage areas of all memory chips 23 can be matched with each other.

6. Exemplary Variation

The present invention can be carried out according to other exemplary embodiments.

For example, the main body casing 2 may be provided with a memory for storing given information on all developing cartridges 6 used in the past in the color printer 1.

In addition, when a plurality of color printers 1 are connected via a network, for example, in a server connected to the network, given information on all developing cartridges 6 mounted to the color printers 1 may be stored.

Without limiting to the tandem color printer 1, the present invention may be applied to an ink-jet printer.

According to the exemplary embodiments of the invention, an image forming apparatus includes: an apparatus main body; a plurality of cartridges which are removably mounted to the apparatus main body and form developer images in respective colors; a nonvolatile memory provided in each of the cartridges; and a storing control unit which is provided in the apparatus main body and stores given information on all of the cartridges in each of the nonvolatile memories by associating the given information with ID information unique to the respective cartridges in response to use of at least one of the cartridges.

Accordingly, a plurality of cartridges for forming developer images in respective colors are removably mounted to the apparatus main body. Each cartridge is provided with a nonvolatile memory. The apparatus main body includes a storing control unit. The storing control unit stores given information on all the cartridges in each of the nonvolatile memories by associating the given information on all the cartridges with ID information unique to the respective cartridges in response to use of at least one cartridge.

Therefore, when a cartridge is used in the state where a communication failure occurs between the storing control unit and at least one nonvolatile memory, even if the given information is not stored in the nonvolatile memory which failed to communicate with the storing control unit, in other nonvolatile memories, given information on all the cartridges including given information on the cartridge having the nonvolatile memory which failed to communicate are stored. Therefore, given information on all cartridges can be accurately held in any of the nonvolatile memories.

The given information may comprise information showing a physical amount which fluctuates along with use of the cartridge.

Accordingly, the given information includes information showing a physical amount which fluctuates along with use of the cartridge, and may be the remaining amount of a developer accommodated in the cartridge or a cumulative number of printing operations (image forming operations) (cumulative number of prints) performed by using the corresponding cartridge. Accordingly, based on the given information, the degree of deterioration and/or the life of the cartridge can be accurately determined. Therefore, maintenance or replacement of the cartridge can be performed at a proper time. As a result, deterioration in the printing quality can be prevented.

In response to use of at least one of the cartridges, the storing control unit may store, in addition to the given information stored previously in each of the nonvolatile memories, the given information (information showing a physical amount) updated according to the use in the nonvolatile memories.

Accordingly, in each nonvolatile memory, in response to use of at least one cartridge, in addition to the given information stored previously (without deleting the given information), given information to be updated according to the use is stored. Therefore, given information change records can be recorded in each nonvolatile memory.

The image forming apparatus may include: a memory-side terminal which is provided in each of the cartridges and is electrically connected to each of the nonvolatile memories; and a main body-side terminal which is provided at the apparatus main body and connected to the memory-side terminals, individually, for communications with the nonvolatile memories.

Accordingly, each cartridge is provided with a memory-side terminal. The memory-side terminal is electrically connected to each nonvolatile memory. The apparatus main body is provided with a main body-side terminal. The main body-side terminal is connected to the memory-side terminals individually for communications with the nonvolatile memories. In the state where the memory-side terminals and the main body-side terminal are connected, each nonvolatile memory and the storing control unit can communicate with each other, and when a connection failure occurs between the memory-side terminal and the main body side terminal, the nonvolatile memory and the storing control unit cannot communicate with each other. With the configuration in which each cartridge is removably mounted to the apparatus main body, a connection failure easily occurs between the memory-side terminal and the main body-side terminal. However, in the nonvolatile memory whose memory-side terminal is excellently connected to the main body-side terminal and which can communicate with the storing control unit via the connection, given information on all cartridges are stored, so that given information on all cartridges can be accurately held.

When at least one of the cartridges is used in a state where at least one pair of the memory-side terminal and the main body-side terminal cause a connection failure, after the connection failure is eliminated, in the nonvolatile memory connected to the memory-side terminal which has caused the connection failure, the storing control unit may store the given information stored in the nonvolatile memories other than the nonvolatile memory which has caused the connection failure.

Accordingly, when at least one cartridge is used in the state where at least one pair of memory-side terminal and main body-side terminal causes a connection failure, after the connection failure is eliminated, in the nonvolatile memory connected to the memory-side terminal causing the connection failure, the storing control unit writes given information stored in other nonvolatile memories. Accordingly, given information stored in all nonvolatile memories can be matched with each other.

What is claimed is:

1. An image forming apparatus comprising:

an apparatus main body, including a plurality of cartridges removably mountable to the apparatus main body and accommodating developer of respective colors, each of the cartridges comprising a nonvolatile memory; and a storing control unit configured to store, in each of the nonvolatile memories of the cartridges mounted to the apparatus main body, given information of all of the cartridges mounted to the apparatus main body, a connection failure flag for each of the cartridges, and identification information of the cartridges mounted to the apparatus main body in response to a use of at least one of the cartridges mounted to the apparatus main body, such that the given information and the connection failure flag of each of the cartridges mounted to the apparatus main body is associated with identification information of a respective one of the cartridges mounted to the apparatus main body.

2. The image forming apparatus according to claim 1, wherein the given information comprises information indicating a physical amount that varies along with the use of the cartridge.

3. An image forming apparatus comprising:

an apparatus main body;

a plurality of cartridges removably mountable to the apparatus main body and accommodating developer of respective colors, each of the cartridges comprising a nonvolatile memory;

a storing control unit provided in the apparatus main body and configured to store, in each of the nonvolatile memories, given information of all of the cartridges and identification information of the cartridges in response to a use of at least one of the cartridges, such that the given information of each of the cartridges is associated with identification information of a respective one of the cartridges;

a plurality of memory-side terminals provided at each of the cartridges, each of the memory-side terminals configured to be electrically connected to a respective one of the nonvolatile memories; and a plurality of main body-side terminals provided at the apparatus main body each of the main body-side terminals configured to be connected to a respective one of the memory-side terminals so as to allow the storing control unit to communicate the nonvolatile memories, wherein when at least one of the cartridges is used in a state where at least one pair of terminals, including one of the memory-side terminals and one of the main body-side terminals, causes a connection failure, after the connection failure is eliminated, the storing control unit stores, in the nonvolatile memory connected to the memory-side terminal which has caused the connection failure, the given information stored in the nonvolatile memory other than the nonvolatile memory which has caused the connection failure.

4. The image forming apparatus according to claim 3, wherein the given information comprises information indicating a physical amount that varies along with the use of the cartridge.

5. The image forming apparatus according to claim 4, wherein the storing control unit is configured to store, in addition to given information already stored in a respective one of the nonvolatile memories, given information updated based on the use of the at least one of the cartridges in response to the use of the at least one of the catridges.

6. The image forming apparatus according to claim 3, wherein when at least one of the cartridges is used in a state where at least one pair of terminals, including one of the memory-side terminals and one of the main body-side terminals, cause a connection failure, the storing control unit stores, in the nonvolatile memory connected to the memory-side terminal without the connection failure, connection failure information, which indicates that the connection failure is caused, in association with the identification information of the nonvolatile memory connected to the memory-side terminal which causes the connection failure.

7. The image forming apparatus according to claim 6, wherein the storing control unit is configured to:

determine whether at least one pair of terminals, including one of the memory-side terminals and one of the main body-side terminals cause a connection failure;

determine, when no connection failure is caused, whether the connection failure information is stored in at least one of the nonvolatile memories; and store, if it is determined that at least one of the nonvolatile memories stores the connection failure information, most recent given information without the connection failure information in all of the nonvolatile memories, the most recent given information including the given information stored in the nonvolatile memory other than the nonvolatile memory storing the connection failure information.

8. The image forming apparatus according to claim 3, wherein the storing control unit is configured to:

determine whether same contents of the given information are stored in all of the nonvolatile memories;

determine, when different contents of the given information are stored in the nonvolatile memories, a most recent content of given information from the contents of the given information of all of the nonvolatile memories; and store the most recent content of given information in all of the nonvolatile memories.

9. The image forming apparatus according to claim 3, wherein the storing control unit stores, in at least one of the nonvolatile memories, a connection failure flag indicating the connection failure.

10. The image forming apparatus according to claim 9, wherein the connection failure flag is associated with the identification information of the cartridge having the memory-side terminal which has caused the connection failure.

11. A non-transitory computer readable medium having a computer program stored thereon and readable by a computer, said computer program, when executed by the computer, causes the computer to perform operations for an image forming apparatus to which a plurality of cartridges are removably mountable, said operations comprising:

detecting a use of at least one of the cartridges mounted to the image forming apparatus;

determining whether a connection failure between at least one of the cartridges and the image forming apparatus has occurred;

storing, in each of nonvolatile memories respectively provided in the cartridges for which a connection failure has not occurred, given information of all of the cartridges mounted to the image forming apparatus, a connection failure flag for each cartridge for which a connection failure has occurred, and identification information of the cartridges mounted to the image forming apparatus in response to the use of at least one of the cartridges mounted to the image forming apparatus, such that the given information of each of the cartridges mounted to the image forming apparatus and the connection failure flag for each cartridge for which a connection failure has occurred is associated with identification information of a respective one of the cartridges mounted to the image forming apparatus.

12. The non-transitory computer readable medium of claim 11, wherein the given information comprises information indicating a physical amount that varies along with the use of the cartridge.

* * * * *